United States Patent [19]

Wild

[11] 4,229,285

[45] Oct. 21, 1980

[54] DUST REMOVAL IN AN OPENING AND CLEANING APPARATUS FOR FIBROUS MATERIALS

[75] Inventor: Gerald Wild, Pickup Bank, Near Darwen, England

[73] Assignee: Platt Saco Lowell Limited, Helmshore, England

[21] Appl. No.: 918,304

[22] Filed: Jun. 22, 1978

[51] Int. Cl.[3] ..... B07B 1/04

[52] U.S. Cl. ..... 209/3; 209/243; 209/250; 209/283; 209/358; 209/380; 19/93

[58] Field of Search ..... 209/3, 26–29, 209/34–37, 243, 234, 250, 283, 324, 358, 380, 278, 352, 312, 318, 321; 19/200, 205, 93–95

[56] References Cited

U.S. PATENT DOCUMENTS

| | | | |
|---|---|---|---|
| 1,879,016 | 9/1932 | Austin | 209/28 X |
| 2,844,847 | 7/1958 | Smith | 19/93 X |
| 3,890,220 | 6/1975 | Anderson | 209/3 |
| 4,025,989 | 5/1977 | Naarding et al. | 19/93 |
| 4,123,213 | 10/1978 | Laramore | 209/234 X |

*Primary Examiner*—Ralph J. Hill

*Attorney, Agent, or Firm*—Donald H. Feldman

[57] ABSTRACT

In the opening and cleaning of fibrous materials apparatus is provided which includes a plurality of rotatable beaters within a housing, curved under grids beneath each rotatable beater, baffle plates above and between the beaters, a perforated screen positioned above and adjacent the beaters and a suction hood positioned over and embracing the whole upper surface of the perforated screen. The screen is inclined to the horizontal and the apparatus includes a suction duct extending across the lowermost edge for withdrawing air from an inlet slot along the opposite edge to create an air stream flowing over the whole surface of the screen such that dust and unusable fibres passing through the screen are carried away to a waste extraction duct.

13 Claims, 3 Drawing Figures

DUST REMOVAL IN AN OPENING AND CLEANING APPARATUS FOR FIBROUS MATERIALS

BACKGROUND OF THE INVENTION

The invention relates to apparatus for opening and cleaning fibrous material. More particularly the invention relates to the removal of dust from fibrous material.

In a previously known opening and cleaning apparatus as shown in U.S. Pat. No. 2,844,847 there is disclosure of an arrangement of this kind including above the beaters a large dust chamber separated from the beaters by an inclined perforated screen. A disadvantage occurs in this arrangement as it relies on a high amount of suction applied to the exhaust duct located in the topmost wall of the chamber to lift the dust and trash away to waste. Such an arrangement is very inefficient in operation in that short fibres passing through the screen pill together in the air currents and do no lift from the chamber and consequently a blockage can result which will prevent proper functioning of the machine.

U.S. Pat. No. 4,025,989 also discloses a similar arrangement of an opener and cleaner for fibrous materials in which a dust chamber is provided over a beater arrangement and a suction source is connected to an exhaust outlet in the topmost wall of the dust chamber. Separate guide plates are positioned above each beater, these being provided with perforations for the extraction of fine dust from the material being processed. These perforated guide plates do not form a continuous screen to prevent material being processed from being flung upwardly into the dust chamber. This arrangement is disadvantageous in that in some situations usable fibres can be extracted along with unusable fibres and dust through the suction outlet. Additionally it is difficult to properly separate dust from the fibres and in some arrangements very little dust is withdrawn through the exhaust outlet.

In the above disclosures of the prior art it is difficult to remove dust without causing short unusable fibres to interfere with the proper function of the machine. Additionally it is also difficult to extract dust without extracting usable fibres and in some cases, difficult to extract an adequate percentage of dust.

It is therefore an object of our invention to provide apparatus and a method of extracting dust and unusable fibres in a more efficient manner.

SUMMARY OF INVENTION

These objects are achieved by the provision of apparatus for opening and cleaning fibrous material comprising a beater, a flat perforated screen adjacent the beater such that in use material forwarded by the beater is caused to contact the screen, the screen having perforations such that usable fibres are prevented from passing through but unusable fibres and dust may pass through and having suction means positioned at one edge of the perforated screen at its side which is remote from the beater, the suction means creating a stream of air across the full surface of the perforated screen for conveying unusable fibres and dust away to waste.

These objects are also achieved by a method of extracting dust from fibrous materials in which material is forwarded to contact a perforated screen, the screen having perforations such that usable fibres are prevented from passing through but unusable fibres and dust may pass through and an air stream is provided to pass along the full surface of the perforated screen at its side which is remote from the side contacting the material being opened, the unusable fibres and dust are then conveyed by the suction air stream away to waste, the suction means being positioned at one edge of the perforated screen.

BRIEF DESCRIPTION OF THE DRAWINGS

The following is a more detailed description of one embodiment of the invention by way of example, reference being made to the accompanying drawings in which.

DESCRIPTION OF ONE EMBODIMENT

Figure 1:
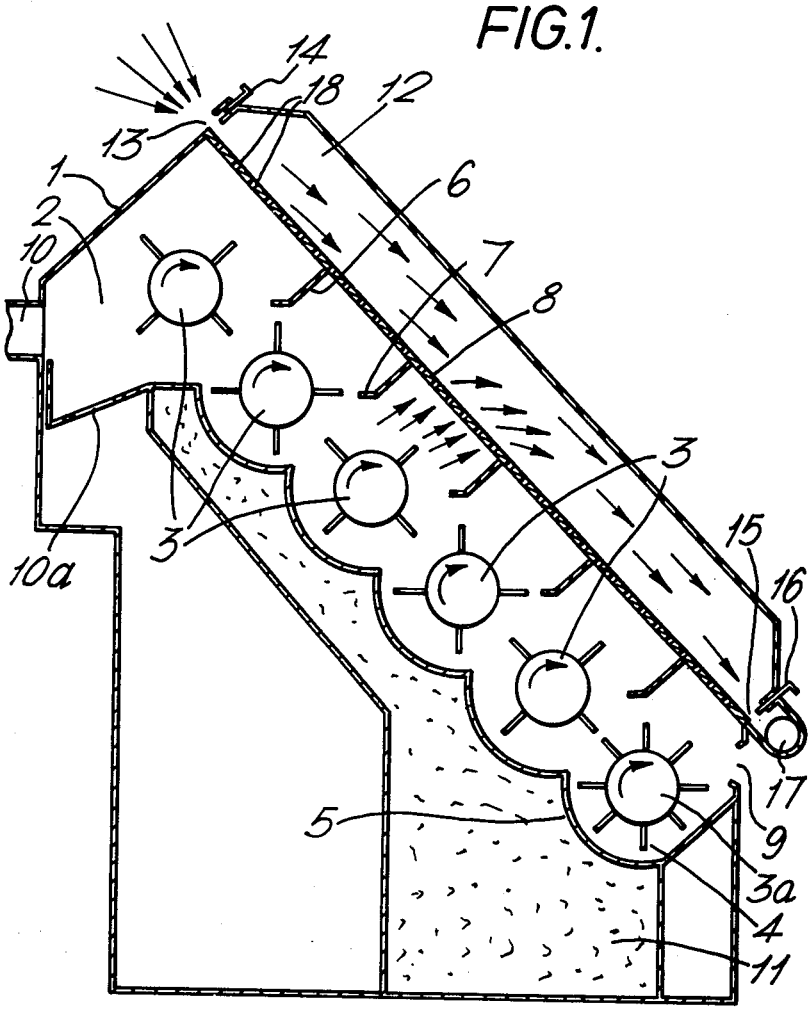
FIG. 1 is a longitudinal cross-sectional elevation of an opener and cleaner for fibres.

With reference to the drawings the apparatus comprises a stepped opener and cleaner having a main frame 1 wherein a compartment 2 houses a plurality of beaters 3 and 3*a* with spikes 4 around their periphery. Undergrids 5 are fitted adjacent the beaters 3 and 3*a* and baffle plates 6 with angled portions 7 are positioned above and between the beaters 3 and 3*a*.

An inlet opening 9 is provided in the compartment 2 for feeding material for processing, outlets are also provided at 10 and 10*a* for discharging the processed material. Suitable means (not shown) are used to direct the material to outlets 10 or 10*a*. Outlet 10 is provided for the extraction of material by pneumatic means and outlet 10*a* can conveniently be used to drop material on to a conveyor (not shown). A trash collecting chamber 11 is situated beneath the undergrids 5 to collect trash extracted from the material during processing. The apparatus as so far described is conventional and has been used for many years.

Figure 2:
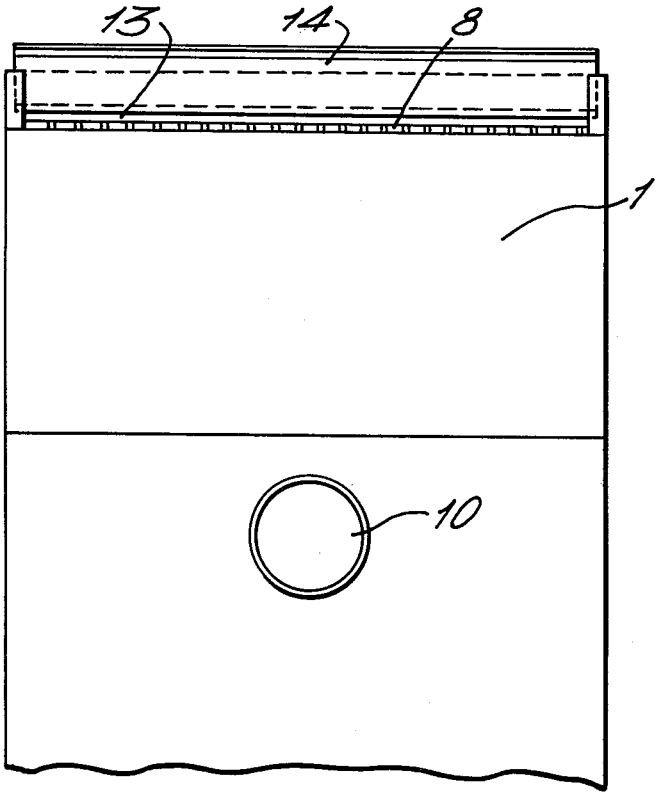
FIG. 2 is an enlarged view of a side elevation of FIG. 1 showing details of the air inlet and damper arrangement.
Figure 3:
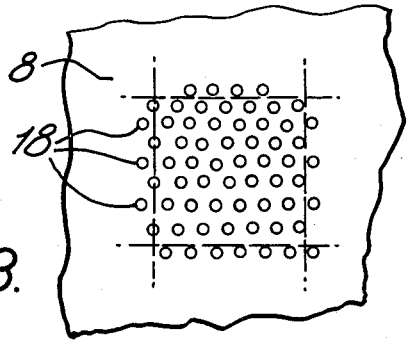
FIG. 3 is a scrap section of a perforated screen illustrating one example of the size of perforations used.

In our improved apparatus the compartment 2 has a perforated screen 8 fitted in parallel relationship to the plane containing the axes of the beaters 3 and 3*a*. The screen 8 which may comprise a single sheet or may be made up from a plurality of separate sheets in edge to edge relationship substantially covers the inclined longitudinal top side of the compartment 2. The perforated screen or screens 8 are made from sheet metal with punched round apertures 18. In FIG. 3 of the drawings a full scale illustration of one example of size and population of the perforations is shown. In this example 42 perforations 3/32" diameter are contained within one square inch. The above example is suitable for a variety of materials but screens of different perforation diameter and/or population as for example 1/16" to ¼" diameter and between 9 to 100 perforations per square inch can be used to process difficult materials and to extract the required percentage of dust and short unusable fibres. Perforated screens having differently shaped apertures may also be used and self-cleaning perforated screens which have apertures so shaped as to prevent clogging can be used. A hood 12 is positioned immediately above and embracing the perforated screens 8. The hood 12 is made of fabricated sheet metal, is substantially rectangular in shape, has an open base and has portions tapering towards the base at each end. These tapering portions help to direct the air flow within the hood. An air inlet aperture 13 is provided and extends across the width of the hood 12 and in co-operation with a slidable damper 14 provides a rectangular aperture 13 of adjustable heights (an enlarged view of the damper arrangement is shown in FIG. 2). At the other end of the hood an air and dust extraction outlet 15 is provided which is also rectangular in shape and extends across the width of the hood 12. A slidable damper 16 is also provided to the air inlet arrangement as shown in FIG. 2 to enable adjustment of the height of the outlet. Both the apertures 13 and 15 are bordered along one side by the screen 8. A means for removing dust laden air is provided by a suction outlet 17 which is connected by suitable piping (not shown) to a means of air extraction (not shown).

Inspection apertures (not shown) with transparent covers are provided in the sides of the hood 12, which may be removed to allow access for cleaning. These inspection apertures provide the facility of observing (by shining a light through the apertures) the air condition within the hood 12 during operation of the machine. By adjusting the dampers 14 and 16 on the hood 12 a desired air condition can be attained.

In operation, material to be processed is fed into the apparatus through inlet opening 9 and is subjected to a beating and opening by the beater 3*a* which has eight spikes 4. The material is loosened and flung centrifugally against the undergrids 5 and the perforated screens 8. Heavy trash falls into the trash collecting chamber 11, and fine dust passes through the perforated screen 8 into the hood 12. The material is then passed to the beaters 3 which have four spikes 4 and are positioned in ascending line to further open and clean the material. Each beater has a number of spikes which, when the beater is rotated, break open and loosen the material so that trash and also fine dust is liberated. The baffle plates 6 serve to contain the material within each separate beater area during processing and the angle portion 7 aids in the direction of the material. As the material is progressed upwardly along a substantially inclined path heavy trash is extracted by the aforementioned action of the beaters flinging material centrifugally against the undergrids 5.

As the fine dust which is present in the material passes through the perforated screen 8 into the hood 12 it is deflected downwardly by the controlled airstream passing over the perforated screen 8. This airstream is generated by the external air extraction means (not shown) which draws or sucks air from the suction outlet 17. The movable dampers 14 and 16 control the size of the apertures in the inlet 13 and outlet 15 so that by adjustment of the two dampers 14 and 16 a controlled airstream is possible. The airstream is drawn fully along and substantially parallel to the screen 8. Referring to the drawing it will be seen that fine dust passing through the perforated screen 8 is deflected downwardly towards the outlet 15 and subsequently sucked away through suction outlet 17. When short fibres pass through the perforated screen 8 along with the fine dust they tend to collect together and roll down the inclined path over the perforated screen 8 to the outlet 15 and are sucked away through suction outlet 17.

The hood 12 which is of low height compared to the compartment 2, typically of 12" height, is so designed to give the facility of balancing the extraction of fine dust and short unusable fibres against the substantially "dead air" condition within the beater compartment 2. If an excessive amount of air is induced through the perforated screen by the effect of the controlled air stream this will interfere with the gravitational fall of heavy trash through the undergrids 5 and could cause trash to be lifted back into the material being processed. By observing the conditions existing within the hood 12 through the inspection apertures the baffles 14 and 16 can be adjusted to give any desired extraction condition to avoid the above situation arising.

Although shown applied to a stepped cleaner, the hood 12 including the apertures 13 and 15 and the perforated screen 8 could be applied to any other device including a beater, where dust is liberated from fibrous material.

That which is claimed is:

1. In an opening and cleaning apparatus for fibrous materials, including a beater, and a perforate screen positioned adjacent said beater such that said materials acted upon by said beater may contact a facing surface of said screen by impact to separate foreign materials including particulate dust and short unusable fibers from usable fibers of said fibrous materials, the improvement comprising said screen being positioned above said beater and being formed with perforations therethrough of a prescribed size sufficient to permit said dust particles and to prevent said usable fibers to pass and from passing therethrough, and means for providing a flow of air adjacent to and along the full perforate surface of said screen which is opposite said facing surface, said means including an inlet to said apparatus for receiving said air flow therethrough adjacent one edge of said opposite surface of said screen and an outlet from said apparatus for discharging said air flow therethrough adjacent another edge of said opposite surface of said screen, whereby said dust particles may be drawn through said perforations and into said air flow and said usable fibers are prevented from being so drawn.

2. The improvement as claimed in claim 1, wherein said screen is inclined to the horizontal, and said outlet is arranged at the lowermost edge of the screen.

3. The improvement is claimed in claim 2, wherein said beater is a plurality of beaters with their horizontal axes of rotation residing in a plane inclined to the horizontal and parallel to the screen.

4. The improvement as claimed in claim 2, wherein a suction hood is located over said screen and parallel with said screen.

5. The improvement as claimed in claim 4, wherein said hood has tapering end portions whereby to direct and contrain said air flow along said opposite surface of said screen between said air inlet and air outlet within and beneath the hood.

6. The improvement as claimed in claim 1, wherein the air inlet is adjustable in size.

7. The improvement as claimed in claim 1, wherein each of said inlet and said outlet extends along its respective full edge of the screen.

8. The improvement as claimed in claim 1, wherein said outlet in the means for providing said flow of air is adjustable in size.

9. The improvement as claimed in claim 1, wherein the perforated screen has perforations of the order of 9 to 100 perforations per square inch.

10. The improvement as claimed in claim 1, wherein the perforated screen has perforations of the order of 1/16 of an inch to ¼ of an inch.

11. In a method for extracting dust from fibrous materials in an opening and cleaning apparatus comprising forwarding said fibrous materials to contact a perforate surface of a perforated screen by impact to separate foreign materials including particulate dust from said fibrous materials, said screen perforations being such that they prevent usable fibres from passing therethrough but allow said dust therethrough, the improvement comprising causing an air stream to pass adjacent to and along the full perforate surface of said screen which is opposite said facing surface which is impacted by said fibrous materials, and admitting said air stream to said apparatus at said opposite perforate surface along one edge of said screen and discharging said air stream along an edge of said screen opposite thereto from said apparatus.

12. The improvement as claimed in claim 11, wherein the screen is inclined to the horizontal and the air stream is caused to pass towards the lowermost edge of said screen.

13. The improvement as claimed in claim 12, wherein the air stream is admitted to said apparatus at the edge of the screen opposite said lowermost edge.

* * * * *